US010464182B2

(12) United States Patent
Junker

(10) Patent No.: US 10,464,182 B2
(45) Date of Patent: Nov. 5, 2019

(54) METHOD AND GRINDING MACHINE FOR GRINDING EXTERNAL AND INTERNAL CONTOURS OF WORKPIECES IN ONE CLAMPING

(71) Applicant: Erwin Junker Maschinenfabrik GmbH, Nordrach (DE)

(72) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 164 days.

(21) Appl. No.: 15/735,267

(22) PCT Filed: Jun. 13, 2016

(86) PCT No.: PCT/EP2016/063472
§ 371 (c)(1),
(2) Date: Dec. 11, 2017

(87) PCT Pub. No.: WO2016/202729
PCT Pub. Date: Dec. 22, 2016

(65) Prior Publication Data

US 2018/0169819 A1 Jun. 21, 2018

(30) Foreign Application Priority Data

Jun. 17, 2015 (DE) ..... 10 2015 211 115

(51) Int. Cl.
*B24B 5/12* (2006.01)
*B24B 41/06* (2012.01)

(52) U.S. Cl.
CPC ..... *B24B 5/12* (2013.01); *B24B 41/062* (2013.01)

(58) Field of Classification Search
CPC ..... B24B 5/12; B24B 41/062; B24B 5/06; B24B 5/185

(Continued)

(56) References Cited

U.S. PATENT DOCUMENTS 2,801,502 A * 8/1957 Blood ..... B24B 5/06 451/27
3,621,617 A 11/1971 Muller
(Continued)

FOREIGN PATENT DOCUMENTS

DE 102007009843 B4 4/2010
GB 2017545 A 10/1979
(Continued)

OTHER PUBLICATIONS

International Search Report for International application No. PCT/EP2016/063472, dated Aug. 19, 2016.

*Primary Examiner* — George B Nguyen
(74) *Attorney, Agent, or Firm* — Marshall, Gerstein & Borun LLP

(57) ABSTRACT

A method and a grinding machine to implement the method includes, in a single clamping, a machine part is ground. The part is clamped on its ends and has an internal recess for grinding. The internal recess is ground with an internal grinding wheel, wherein the part is rotated between a workpiece headstock and a tailstock, and an external contour is ground by means of a grinding wheel. The part is held on the tailstock by a hollow tailstock sleeve, on the end region of the internal recess, and the internal grinding wheel passes through the hollow tailstock sleeve during grinding. In the grinding machine, a separate grinding spindle head carrying the internal grinding wheel can be included in the region of the tailstock, and can be advanced against the peripheral surface of the internal recess by passing through the hollow tailstock sleeve and the hollow center.

17 Claims, 9 Drawing Sheets

(58) Field of Classification Search
USPC ..... 451/27, 57–58, 61
See application file for complete search history.

(56) References Cited

U.S. PATENT DOCUMENTS

| | | | | | |
|---|---|---|---|---|---|
| 4,217,733 | A * | 8/1980 | Van Sickle | B24B 5/185 | 15/88.2 |
| 4,831,785 | A * | 5/1989 | Sigg | B23Q 15/225 | 409/186 |
| 5,899,797 | A * | 5/1999 | Junker | B24B 19/12 | 451/242 |
| 5,989,106 | A * | 11/1999 | Tanaka | B24B 5/04 | 451/49 |
| 6,546,992 | B2 * | 4/2003 | Reusset | B22D 11/057 | 164/121 |
| 8,360,819 | B2 * | 1/2013 | Junker | B24B 5/12 | 451/11 |
| 10,058,968 | B2 * | 8/2018 | Junker | B24B 27/0061 | |

FOREIGN PATENT DOCUMENTS

| | | | |
|---|---|---|---|
| JP | 2000042801 | A | 2/2000 |
| JP | 2000271827 | A | 10/2000 |
| WO | WO-2008104571 | A1 | 9/2008 |

* cited by examiner

METHOD AND GRINDING MACHINE FOR GRINDING EXTERNAL AND INTERNAL CONTOURS OF WORKPIECES IN ONE CLAMPING

CROSS-REFERENCE TO RELATED APPLICATIONS

This is the United States national phase of International Patent Application No. PCT/EP2016/063472, filed Jun. 13, 2016, which claims the priority benefit of German Application No. 10 2015 211 115.6, filed Jun. 17, 2015. Each of the foregoing is expressly incorporated herein by reference in the entirety.

BACKGROUND

The invention relates to a method for the grinding, in one clamping, of a workpiece for which external and internal contours will be ground, as well as a grinding machine used to carry out the method, designed as a universal circular grinding machine and/or a non-circular grinding machine.

DE 10 2007 009 843 B4 has previously disclosed the grinding of both the external contour and the internal contour of a workpiece. In this case, multiple clamping configurations are required to perform the internal grinding after completion of the external grinding—possibly even on separate machines. In addition, the internal contour can only be ground with a support provided by means of a steady rest, after a steady rest seat has been ground accordingly. This known grinding method, and the grinding machine known for the realization of this grinding method, are relatively complex and have limitations in the accuracy which can be achieved with the same. This is due to the fact that the workpiece has to be clamped in different configurations so that all grinding operations can be ground on the workpiece.

Proceeding therefrom, the present invention addresses the problem of providing a grinding method and a grinding machine with which both the external contour and the internal contour of workpieces can be ground with high precision, while the centered clamping is maintained during the grinding operation.

GENERAL DESCRIPTION

The method according to the invention, for grinding a machine part made to rotate about its longitudinal axis, is performed in one and the same clamping. The machine part in this case is preferably a gear shaft and/or a toothed wheel. The machine part is clamped on both of its axial ends, with respect to the longitudinal axis of the machine part, and has an internal recess on at least one of its ends. The internal recess is ground by means of an internal grinding wheel, which is preferably also referred to as an internal mounted point. When clamped, the machine part is held and rotated between a workpiece headstock and a tailstock, wherein the external contour of the machine part is ground by means of at least one grinding wheel. The machine part is therefore held and centered on the end region of the internal recess which faces outward toward the end of the machine part, on one end by means of the workpiece headstock, and on the opposite end by means of a hollow tailstock sleeve on the tailstock. The hollow tailstock sleeve enables passage through the internal grinding wheel during the grinding of the internal recess. Because the hollow tailstock sleeve preferably engages with the internal recess of the machine part via a live hollow center, and the machine part is likewise centrically held on the opposite end in the workpiece headstock, the machine part can be ground both externally and internally in a single clamping, and optionally also on its end faces. Because the grinding is carried out in a single clamping, no reference change occurs for the various grinding operations implemented with different grinding wheels. As a result, it is possible to increase grinding accuracy for the machine part. Most importantly, all of the external contours, as well as the internal contours, take one and the same centering—that is, the longitudinal axis of rotation of the machine part—as reference. This also minimizes concentricity errors.

Due to the fact that there is either a hollow tailstock sleeve with a hollow center on the tailstock, or a hollow center on the workpiece headstock, or, if the machine part has an internal recess on each of its ends, there is a hollow tailstock sleeve with a hollow center as well as a workpiece headstock hollow sleeve with a hollow center, through which the respective internal grinding wheel can pass, it is preferably possible for the external grinding and internal grinding to be performed at least partially at the same time. This additionally has a cost-saving effect because it reduces the cycle time during the production of the machine part.

The reference axis for the machine part is preferably maintained during the grinding operation—that is, its longitudinal axis of rotation remains unchanged—because said axis coincides with the centering carried out at both ends of the machine part. Most importantly, in the case of parts with normal length and normal stiffness, a steady rest is not required. In contrast, in the case of a grinding machine according to the prior art according to DE 10 2007 009 843 B4, referred to in the description introduction, it is necessary during the external grinding to furnish a steady rest seat on which, after the seat has been completed, a steady rest can be placed in the corresponding position so that the machine part wanders as little as possible from its previously fixed centering in the clamping. Only after the steady rest support has been completed, the internal grinding of the recess present on the end faces or on the end face of the machine part can be carried out. According to the present invention, the phrase 'without steady rest support' is used to mean that a steady rest is no longer necessary for the purpose of making the internal recess available so that the same can be ground, wherein according to the prior art, the clamping on the tailstock needed to be released to this end. However, it should be understood that, in the case of especially long components, steady rests can be furnished—specifically distributed over the length of the component in such a manner that deformation of the machine part relative to its longitudinal axis is prevented or minimized during machining of the external contour, with the accompanying grinding forces. For the purpose of grinding the internal recess, however, no special steady rest support is required, due to the existing hollow centers and/or hollow sleeves.

So that an effective centering of the machine part can also be realized on the workpiece headstock, the workpiece headstock is equipped either with a centrically clamping chuck or with a chuck with equalizing jaws and a centering tip which engages with the end face of the machine part. However, it is also possible that, in the event that the machine part also has an internal recess on the end of the workpiece headstock, the workpiece headstock has a workpiece headstock hollow sleeve with a hollow center, so that from this side as well, the internal grinding wheel can grind the internal recess through the workpiece headstock, which then has a hollow design, without the need to release the clamping during the grinding, or for the purpose of the internal grinding.

According to a preferred embodiment, the internal grinding wheel with its spindle, and the grinding wheel used for external grinding, likewise with its spindle, are arranged on the same, shared headstock, and are brought into engagement with the machine part, or brought out of engagement therefrom, by swiveling and/or moving—in particular continuously. The respective spindles of the respective grinding wheels can be moved by a swiveling arrangement on a carriage, in a direction parallel to the longitudinal axis of the machine part, for the grinding of the internal recess and for the grinding of the external contour.

According to a further embodiment of the invention, the grinding wheel for the external grinding is arranged on a grinding spindle head which is then swiveled and or moved toward the workpiece to bring the grinding wheel into engagement for the external grinding. In addition, the internal grinding wheel is arranged on a separate grinding spindle head, preferably in the region of the tailstock, and can be moved relative to the longitudinal axis of the workpiece in such a manner that the internal grinding wheel, which is also termed an internal mounted point, passes through the hollow tailstock sleeve, with the hollow center, in the longitudinal direction of the machine part, and therefore grinds the internal recess. This ensures that the grinding of the external contour of the machine part and the internal surface of the internal recess can be performed at least partially at the same time.

According to a further embodiment, when the external contour of the machine part is ground, the axis of rotation of the grinding wheel for the external grinding, and the shared axis of rotation of the workpiece headstock, the machine part, and the tailstock, are arranged at an oblique angle in space relative to each other, such that the contact between the grinding wheel and the external contour of the machine part is only punctiform. The longitudinal feed is then preferably carried out in the direction of the workpiece headstock. The oblique arrangement of the axes in space relative to each other, which ensures the punctiform contact between the grinding wheel and the external contour of the machine part, is also referred to as quickpoint grinding.

However, it is preferably also possible that, when the external contour of the machine part is ground, the axis of rotation of the grinding wheel, and the shared axis of rotation of the workpiece headstock, the machine part, and the tailstock, are arranged parallel or at an angle in the plane relative to each other, thereby ensuring that the contact between the grinding wheel and the external contour of the machine part is linear. This is advantageous if a longitudinal feed of the grinding wheel is not required, for instance for straight or angular plunge grinding, when the external contour of the machine part is ground on a peripheral surface. If the external contour of the machine part is profiled, the straight or angular plunge grinding can also be performed with a profiled grinding wheel, which of course can also be dressed during downtime, like all other grinding wheels.

Preferably, it is also possible for the grinding wheel used for the external grinding to grind both peripheral regions—preferably rotationally symmetrical in nature—and end faces of the machine part.

The hollow tailstock sleeve is preferably live; however, it can also be driven. Preferably, the drive of the hollow tailstock sleeve is matched to the drive of the workpiece headstock on the opposite side, like an electronic shaft.

Preferably, the machining of the machine part is implemented using CNC controls. This means that all movements of the machine part or the grinding tool are performed with CNC control.

According to a second aspect of the invention, a grinding machine of the universal circular grinding machine and/or non-circular grinding machine type is provided to carry out the method described above. In the conventional manner, the grinding machine has a grinding table on which a workpiece headstock and a tailstock are arranged and are able to move in the longitudinal direction of the grinding table. A machine part which will be ground can be clamped between the workpiece headstock and the tailstock, in such a manner that the shared longitudinal axis of the workpiece headstock, the machine part, and the tailstock extends in the longitudinal direction of the grinding table.

However, it is also possible that the grinding table is fixed with respect to the machine bed, and the grinding spindle head and/or the grinding spindle heads can be moved parallel to and along the common longitudinal axis of the workpiece headstock, the machine part, and the tailstock.

The workpiece headstock comprises either a centrically clamping chuck or a chuck with equalizing, releasable jaws and a centering tip which holds and rotates the machine part on the workpiece headstock. Both types of chuck ensure centering for the clamping of the machine part on the workpiece headstock. The tailstock has a hollow tailstock sleeve with a preferably live hollow center, in the manner of a mounting point which engages in a bevel of the internal recess. This hollow center engages in the internal recess of the machine part in such a manner that a centering engagement is ensured, specifically in such a way that this centering engagement is adapted to a rotationally symmetrical internal recess on at least one end of the machine part which can be clamped on the tailstock—that is, on the end opposite the workpiece headstock.

The hollow tailstock sleeve and the hollow center have an internal bore which is made large enough so that the internal grinding wheel can pass through the internal bore of the hollow sleeve and the hollow center to grind the internal recess—that is, the internal surface of the internal recess. The internal grinding wheel, with its internal grinding spindle, can at this point be arranged either on the grinding spindle head, which is able to swivel- and move in such a manner that the internal grinding wheel can pass through the internal bore of the hollow tailstock sleeve and accordingly grind the internal recess. The disadvantage of such an arrangement is that the external grinding and internal grinding must be performed one after the other. However, for further optimization—specifically for time and cost—of the grinding operation in the grinding machine according to the invention, a separate grinding spindle head is preferably arranged in the region of the tailstock, and preferably carries the internal grinding wheel with its internal grinding spindle. The advancement of the internal grinding wheel, passing through the hollow tailstock sleeve, then occurs substantially in the direction of the longitudinal axis of the machine part, such that the internal peripheral surface of the internal recess can be ground, and particularly at least partially at the same time as the grinding of the external contour of the machine part. The grinding machine according to the invention preferably has both a swivelable grinding spindle head, also with a grinding spindle which carries an internal grinding wheel, as well as the separate grinding spindle head as an additional grinding spindle head.

In the grinding machine according to the invention, the workpiece headstock and the tailstock can move relative to each other in such a manner that the machine part is held and rotated under axial pressure between the centering tip on the workpiece headstock, or the centrically clamping chuck included in the same, and the hollow center on the tailstock, without any change in the reference axis of the clamping. Therefore, the grinding machine according to the invention enables external grinding and internal grinding, performed at least partially at the same time. Because the grinding operation is carried out in one and the same clamping on the grinding machine according to the invention, the reference axis is not changed during the grinding, thereby achieving higher precision of the machine parts ground with the grinding machine according to the invention.

Preferably, a carriage which can move in a controlled manner perpendicularly to the longitudinal direction of the grinding table is included, and a grinding spindle head which can swivel about a perpendicular swivel axis is arranged thereon. On this grinding spindle head, the grinding wheel which is driven to rotate is brought into a machining engagement with the machine part to grind the outer contour of the same, wherein the grinding wheel is mounted on the grinding spindle head with its axis of rotation extending horizontally, for grinding the external contour.

Preferably, the grinding wheel has an abrasive layer on both its circumference and on its end face. It is thus possible, with the grinding machine according to the invention, to grind cylindrical external contours as well as end faces or cones on the machine part, and optionally even in the course of plunge grinding, without the need to release the clamping.

Preferably, the internal grinding wheel, and the grinding wheel for the external contour, are both equipped with a CBN coating. The CBN coating ensures high grinding accuracy, high grinding rate, and yet long service life of the grinding wheels.

If the machine part has an internal recess on the end of the workpiece headstock which clamps the machine part, the chuck is preferably hollow so that a further internal grinding wheel used for grinding this internal recess can pass through the hollow bore of the chuck on the workpiece headstock end of the machine part. This further internal grinding wheel is preferably arranged on a further, separate internal grinding spindle head, such that this further internal grinding wheel can be moved and advanced independently of the grinding spindle head used for the external contour. Even if there are internal recesses at both ends of the machine part, it is therefore possible to grind both the external contour and the internal contours at the same time using the grinding machine according to the invention.

BRIEF DESCRIPTION OF THE DRAWINGS

Further embodiments and details of the present invention will now be explained in detail with reference to the accompanying drawings, wherein:

FIG. 4: shows a partial view of a grinding machine, with the grinding spindle, comprising the internal grinding wheel, swiveled-in;

DETAILED DESCRIPTION

Figure 1:
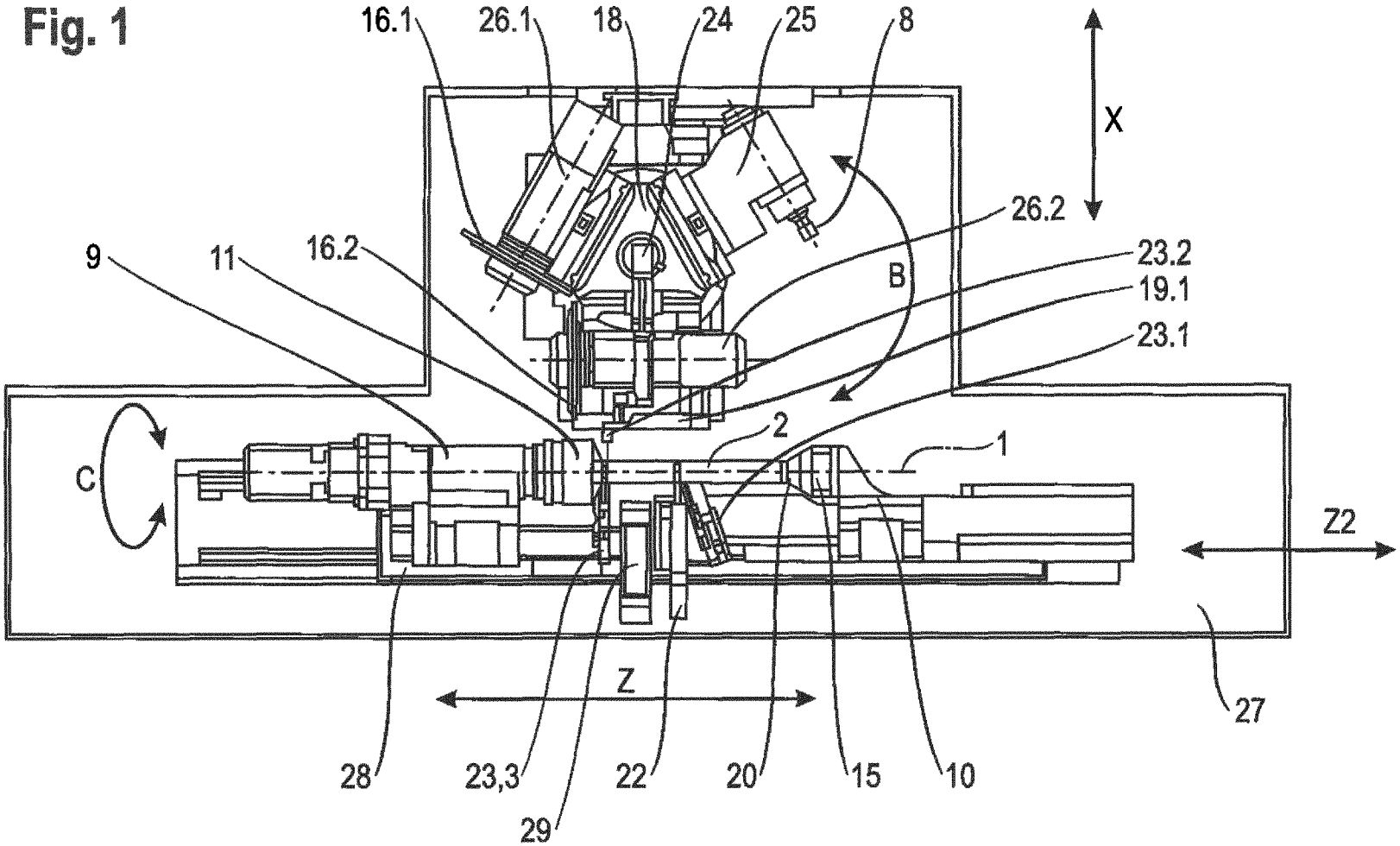
FIG. 1: shows a grinding machine according to the invention, in top view.

The grinding machine shown in top view in FIG. 1 has a basic construction which generally accords with the construction of a universal circular grinding machine and/or non-circular grinding machine. A grinding table 28 disposed in the conventional manner has guided longitudinal movement on a machine bed 27 in the direction of a so-called Z-axis. A workpiece headstock 9, with its drive motor (not indicated) and a chuck 11, is mounted on the grinding table 28. The chuck 11 is used to clamp the workpiece—that is, the machine part 2. The machine part is clamped on the workpiece headstock 9 by means of a centering tip 13 and the releasable clamping jaws 12 of the chuck 11.

A tailstock 10 is arranged coaxially with the workpiece headstock 9 at an axial distance from the same. The tailstock 10 has a separately constructed spindle sleeve to accommodate a tailstock center designed as a hollow tailstock sleeve 15. The tailstock 10 is likewise arranged on the grinding table 28, such that the machine part 2 is clamped in the conventional manner between the workpiece headstock 9 and the tailstock 10, in the same rotary axis—the longitudinal axis 1 of the machine part 2. For process monitoring, measuring devices 23.1, 23.2 and 23.3 are included in the grinding machine. These are used to measure external- and/or internal diameters. The measurement signals obtained from the measuring devices are used for monitoring and controlling the grinding machine, wherein the measurement signals are fed directly to the controller of the grinding machine in the usual manner. As is likewise conventional, a dressing device 29 is included to dress grinding wheels used in the grinding machine. Also shown is a steady rest 22 which partially surrounds the circumference of the machine part when in active use, and which is furnished only if the machine part is comparatively long, in order to compensate for the grinding forces exerted by abrasive grinding wheels during the grinding of the external contour. A steady rest is not required in the end region of the machine part for the purpose of internal grinding, as is the case in the prior art. It is merely optional and serves only to prevent the deflection of a relatively long machine part potentially caused by grinding forces. In the case of shorter components which have sufficient bending stiffness, the steady rest can be dispensed with.

The grinding machine has a grinding spindle head 18, the same having a grinding spindle 25 with a grinding wheel 8 for internal grinding, a grinding spindle 26.1 with a first external grinding wheel 16.1, and a grinding spindle 26.2 with a second external grinding wheel 16.2. This means that the three grinding spindles 25, 26.1 and 26.2 are all arranged on the same, shared grinding spindle head 18. The grinding spindle head 18 is arranged on a carriage 19.1 in a manner which enables swiveling about a swivel axis 24. The carriage 19.1 in turn is able to slide perpendicularly to the common axis of rotation—that is, the longitudinal axis 1. The carriage 19.1 can therefore slide in the conventional X-axis. The swivel movement of the grinding spindle head 18 is indicated by the curved double arrow B. The sliding movement of the carriage 19.1 is indicated by the straight double arrow X. Z indicates the sliding movement in the direction of the longitudinal axis 1 of the machine part 2, while C indicates the rotation of the machine part about the common axis of rotation—that is, the longitudinal axis. The swiveling of the grinding spindle head 18 brings each of the grinding wheels needed for the machining process—that is, the internal grinding wheel 8, the first external grinding wheel 16.1 and/or the second external grinding wheel 16.2—into engagement with the machine part 2, to execute their respective grinding tasks.

In the described embodiment according to FIG. 1, the external contour and the internal contour of the machine part 2 are ground one after the other; the arrangement of all grinding wheels with their grinding spindles on one grinding spindle head 18 means that the respective grinding tasks can only be carried out one after the other. In any case, the machine part remains in one and the same clamping with one and the same centering in the grinding machine according to the invention—specifically for both the grinding of the external contour and the grinding of the internal contour. The first external grinding wheel 16.1 is used to grind the external contour of the machine part 2. The second external grinding wheel 16.2 can grind both rotationally symmetrical peripheral faces and end faces of the machine part 2. This ensures that end faces of the machine part 2, if present, can also be ground in the same clamping. The grinding spindle 25 carries the internal grinding wheel 8, which has a small diameter and serves to grind the rotationally symmetrical internal recess 6 of the machine part 2, in a configuration where the internal grinding wheel 8 passes through the hollow tailstock sleeve 15. Due to the small diameter of the internal grinding wheel 8, it is also called a mounted point. The method according to the invention can be carried only with the internal grinding spindle 25 with the internal grinding wheel 8, and the grinding spindle 26.2 with the external grinding wheel 16.2. The grinding spindle 26.1 also arranged on the grinding spindle head 18, with its external grinding wheel 16.1, can be utilized for further machining operations on the machine part—for example, to grind additional peripheral surfaces and end faces, or cut-ins.

A further advantage of the method according to the invention arises when the internal recess 6 is ground by means of the internal grinding wheel 8, which passes through the hollow tailstock sleeve 15. This is that the cooling lubricant is fed directly through the hollow tailstock sleeve 15 to the inner surface, of the internal recess 6, with which the internal grinding wheel 8 engages during the grinding of the internal recess 6. This makes it possible for the cooling lubricant to be fed directly to the grinding area in an optimum manner.

Figure 2:
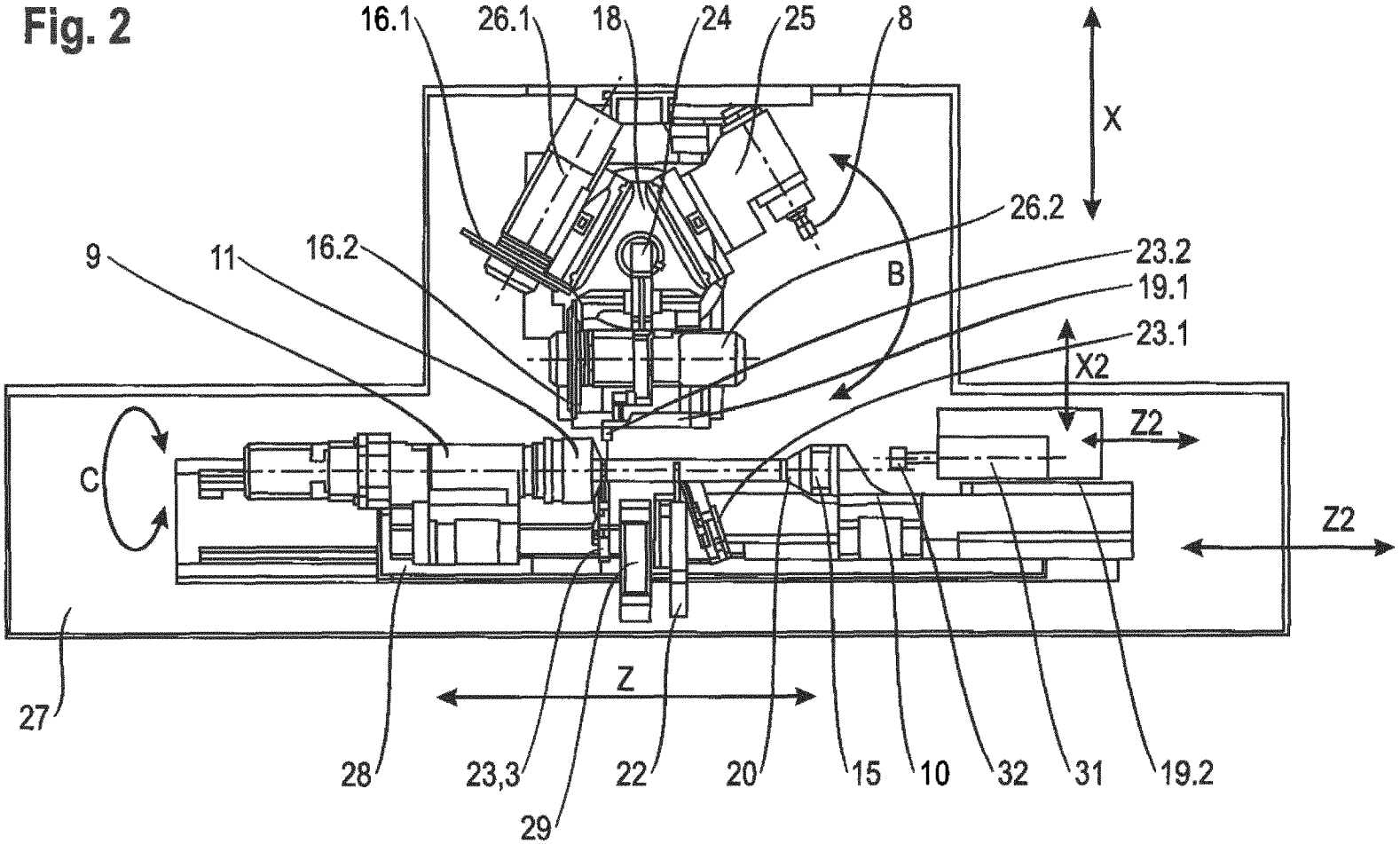
FIG. 2: shows a grinding machine which corresponds to the basic structure in FIG. 1, but has an additional internal grinding spindle head.

FIG. 2 shows a top view of a grinding machine according to the invention, in a basic illustration which substantially corresponds to the grinding machine according to FIG. 1. As such, the same reference numerals refer to the same components or elements. In contrast to FIG. 1, however, the grinding machine according to FIG. 2 has an additional internal grinding spindle head 30 in the region of the tailstock 10. This internal grinding spindle head 30 is likewise arranged on the machine bed 27 and carries a further internal grinding spindle 31 in the manner of a further, second carriage 19.2, which carries a further internal grinding wheel 32. The further internal grinding spindle 31 is able to slide on the carriage 19.2 in the Z2-direction—that is, in the direction of the longitudinal axis 1 of the machine part 2, and can therefore be inserted through the hollow tailstock sleeve 15 into the internal recess 6 for the machining of the same. In addition, the carriage 19.2 can be moved in the X2-direction, such that the feed can be adjusted according the machining operation in the internal recess.

Figure 3:
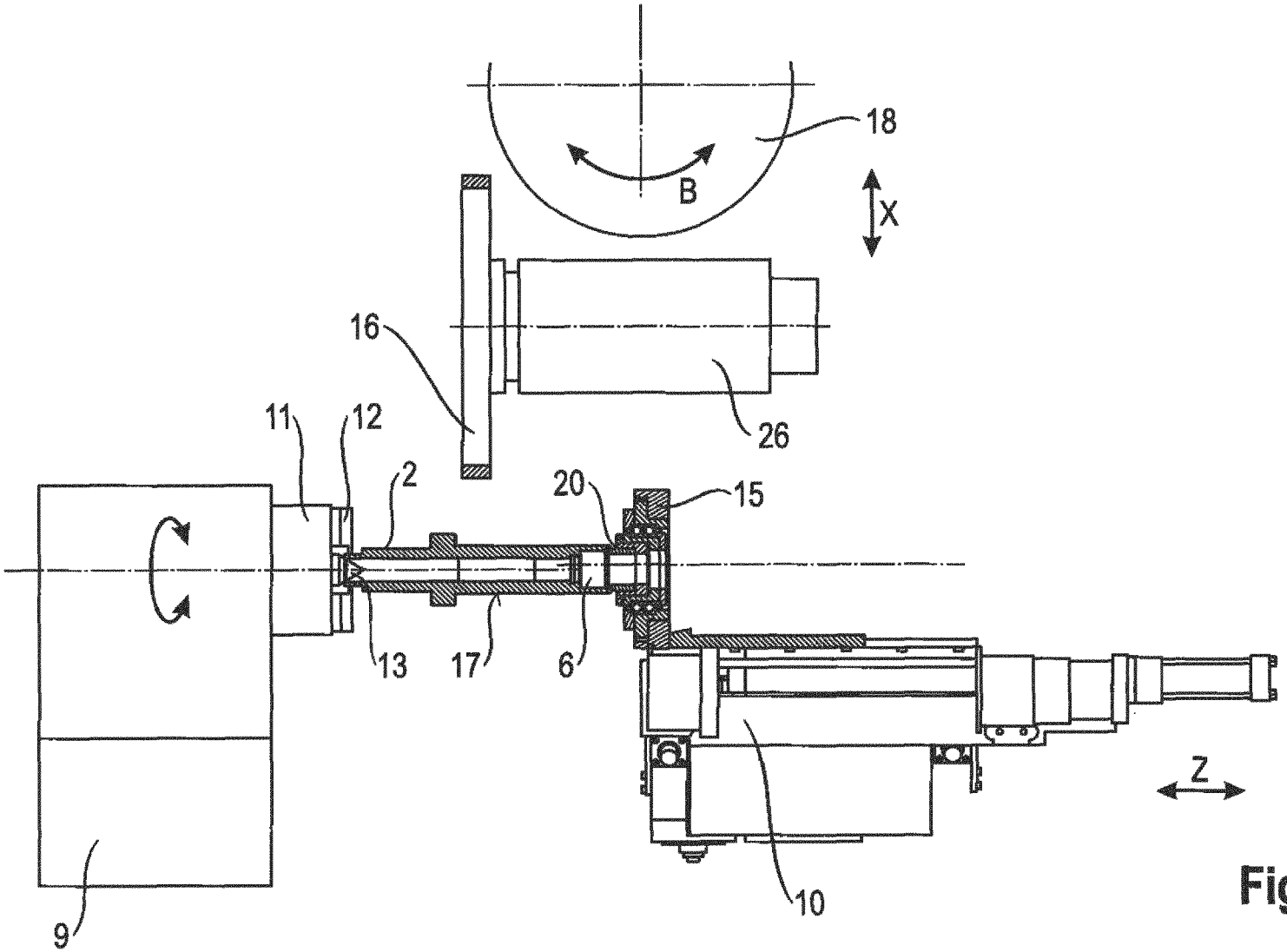
FIG. 3: shows a partial view of the grinding machine according to the invention, the grinding wheel, comprising the external grinding spindle, swiveled-in for the external grinding of the machine part.

FIG. 3 shows a detailed view of the basic construction of the grinding machine according to the invention in FIG. 1. The machine part 2 is clamped on the workpiece headstock 9 in the chuck 11, with respect to its longitudinal axis 1, between the centers by means of the clamping jaws 12 and the centering tip 13, and on the tailstock 10 by means of the hollow tailstock sleeve 15 and the live hollow center 20. This clamping between the centers is maintained throughout the machining process. The machine part 2 has, in its left half, a circumferential collar comprising the end faces which face the workpiece headstock 9 and the hollow tailstock sleeve 15. Moreover, the machine part 2 has a shoulder in the region of the clamping in the workpiece headstock 9, which also forms an end face. On the grinding spindle head 18, the swivel movement of which is indicated by curved double arrow B, the grinding spindle 26 with the external grinding wheel 16 is swiveled in the direction of the workpiece for the external grinding thereof. The entire cylindrical external contour 17 of the machine part 2 is ground by means of the external grinding wheel 16. The external grinding wheel 16 is designed in such a manner that it can also grind the end faces on the machine part 2 with its front edge. The external grinding wheel 16 is advanced over the X-axis toward the external contour 17 of the machine part 2, such that the external grinding can be performed by means of this external grinding wheel 16. The ability of the grinding spindle 26, together with its external grinding wheel 16, to slide in the Z-direction enables the grinding of the end faces of the peripheral collar, as well as the end faces of the shoulder in the region of the workpiece headstock 9. This makes it possible to grind the entire external contour of the machine part 2.

The tailstock 10 is not equipped with a conventionally designed sleeve. Rather, it has a bored-out hollow sleeve with a very short mount. A hollow center 20 is included in the bore of the hollow tailstock sleeve 15, forming the tailstock center. It engages with the end-face region of the machine part 2 in such a manner that the machine part 2 is clamped on the end facing the tailstock 10 with respect to its longitudinal axis 1, and centered with respect to the longitudinal axis 1. The hollow bore of the hollow tailstock sleeve 15 enables a grinding wheel (not shown) used for the internal grinding to pass through the hollow bore into the region of the internal recess 6 of the machine part 2, in order to perform the machining of the internal recess.

Figure 4:
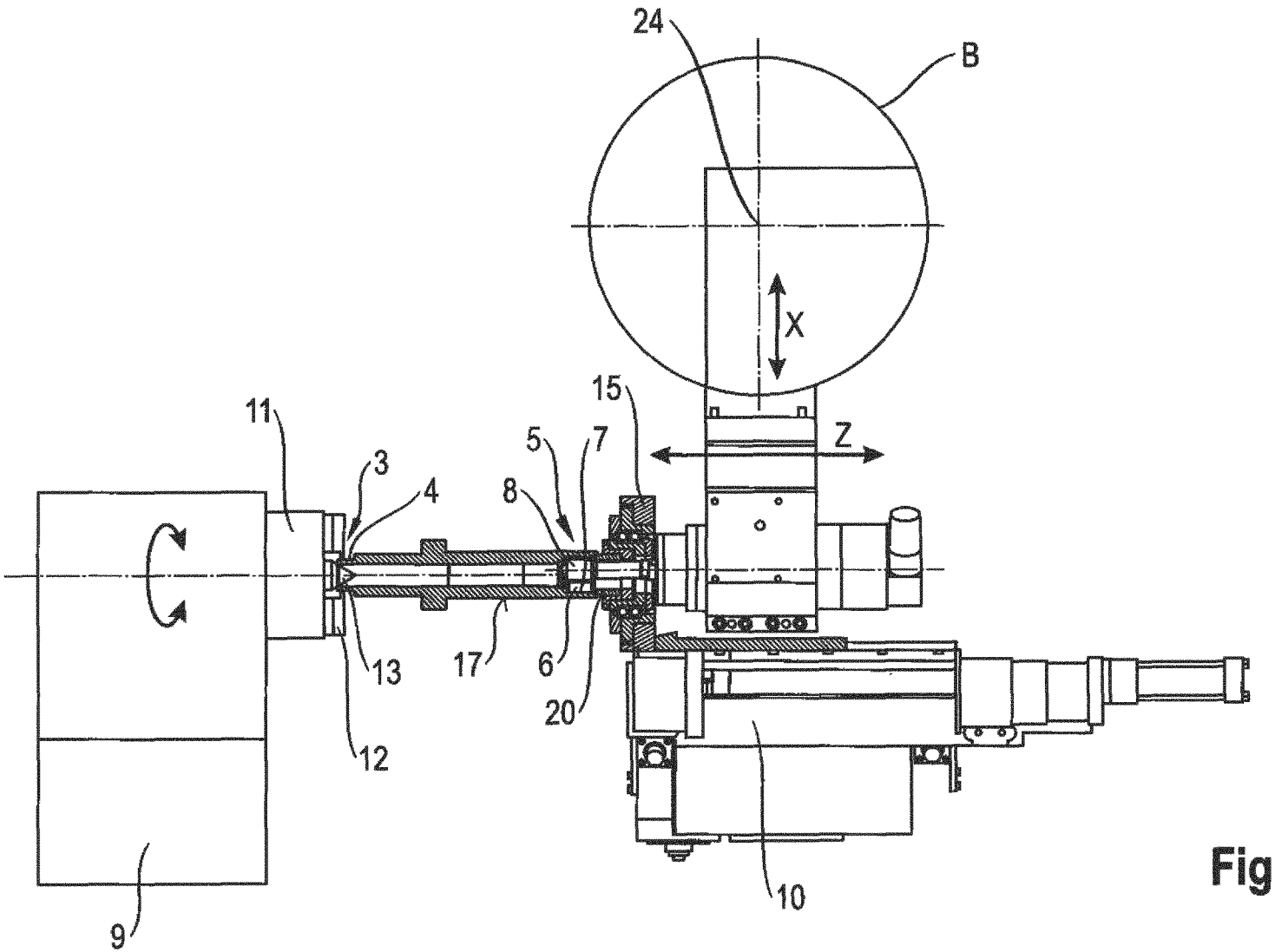

FIG. 4 shows a grinding machine in a detailed view and top view, according to the view of FIG. 1, wherein the internal recess 6 is ground on the machine part 2. The machine part 2 is again held centrically in the workpiece headstock 9 by its left end, by means of the chuck 11 and the clamping jaws 12, as well as the centering tip 13. Similarly, the machine part 2 is likewise clamped centrically, on the end 5 opposite thereto, in the tailstock 10 by means of the hollow tailstock sleeve 15 thereof, via the live hollow center 20 in the same—specifically in such a manner that the longitudinal axis 1 of the machine part 2 forms its axis of rotation. The external contour 17 of the machine part has been ground in the manner described in connection with FIG. 3. For the internal grinding of the internal recess 6, the internal grinding wheel 8 with its internal grinding spindle 25, which is mounted on the grinding spindle stock 18 and can swivel about the swivel axis 24 thereof, has been swiveled into the recess 6 of the machine part 2 through the hollow bore of the hollow tailstock sleeve 15, and brought into a machining engagement. In addition to the ability of the internal grinding spindle 25 to swivel about the swivel axis 24, the grinding spindle head 18 can be brought into a machining engagement in the internal recess along the X-axis. In addition, so as to pass through the hollow tailstock sleeve 15, the internal grinding wheel 8 can be moved in the Z-direction in such a manner that the internal grinding wheel 8 can be guided through the hollow bore of the hollow tailstock sleeve 15 into the internal recess 6 of the machine part 2.

The tailstock 10 is mounted very short—that is, has a short construction in the axial direction—and has a hollow inner bore as described. During the internal grinding, the machine part 2 remains clamped between the centers.

Figure 5:
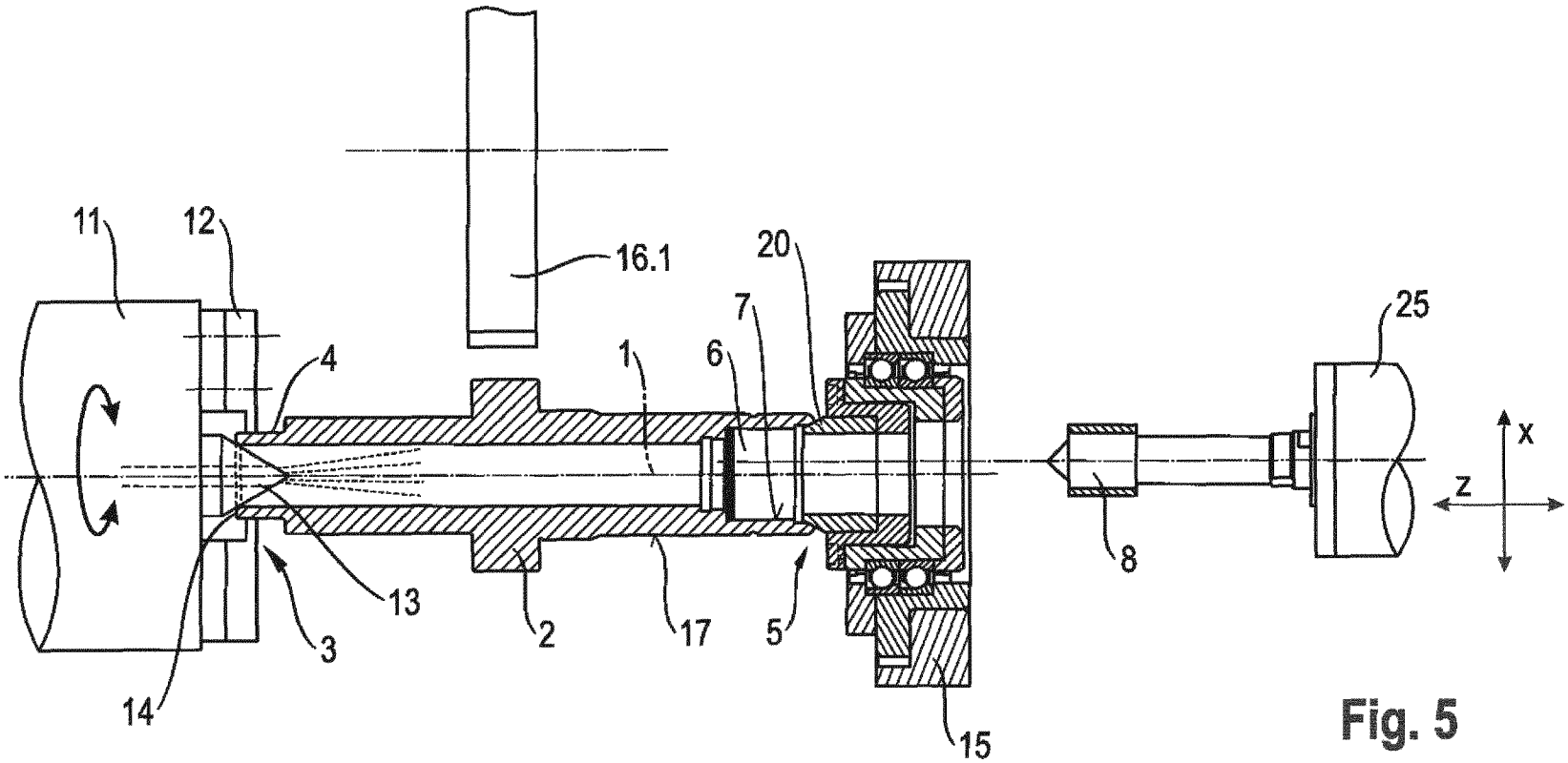
FIG. 5: shows a detailed view of the machine part clamping in the workpiece headstock by the chuck, as well as the clamping by the hollow tailstock sleeve, with the internal grinding wheel out of engagement.

FIG. 5 shows, in an enlarged detail view, the machine part 2 which is centrically clamped in the chuck 11, in the jaws 12, on the longitudinal end face 14 of the machine part 2, by means of the centering tip 13. At the opposite end 5 of the machine part 2, the live hollow center 20 of the hollow tailstock sleeve 15 is used for the overall centric clamping of the machine part 2.

In contrast to the embodiments according to FIGS. 3 and 4, an embodiment is shown here in which the external contour 17 is ground by means of the external grinding wheel 16 on the grinding spindle head 18, not illustrated, whereas the internal grinding wheel 8 mounted on the internal grinding spindle 25 can be guided through the hollow bore of the hollow tailstock sleeve 15 into the internal recess 6 to grind the internal peripheral surface 7 thereof. In the position shown in FIG. 5, the internal grinding wheel 8 is in a position prior to the passage through the hollow bore of the hollow tailstock sleeve 15. The internal grinding spindle 25 with the internal grinding wheel 8 in the form of a mounted point can be advanced on a separate internal grinding spindle head (not shown) in the Z-direction—that is, in the direction of the longitudinal axis 1—as well as in the X-direction—that is, in the direction toward a machining engagement with the peripheral surface 7 of the internal recess 6.

The mount of the hollow tailstock sleeve 15 is configured with high-precision spindle bearings, wherein the live hollow center 20 revolves with the machine part 2 due to the clamping forces produced by the friction in the center. The live hollow center 20 engages, either with a seal or a positive connection, with an internal surface at the opposite end 5 of the machine part 2. In principle, it would also be possible to perform the machining of the machine part 2 with a centering clamping by means of a stationary center—that is, a non-revolving center. It would be possible—although this is not shown here—for the hollow tailstock sleeve 15 to be designed as a hydrodynamic or hydrostatic bearing.

The cooling lubricant is supplied on the side of the workpiece headstock 9 through the centering tip 13 of the chuck 11. This enables cooling lubricant to reliably move from the side of the workpiece headstock to the internal recess 6, for the grinding thereof, by means of the internal grinding wheel 8. However, this is only possible, of course, if the machine part 2 has a through bore. So that, during the internal grinding, sufficient cooling lubricant can be delivered in this manner to the actual machining engagement point, the internal grinding wheel 8 has a conical attachment on its front which serves to feed the cooling lubricant directly to the machining engagement. Reliable lubrication is particularly important for internal grinding because the internal grinding wheel 8 "nestles" into the peripheral surface 7 being ground, and the region of engagement of the grinding wheel on the peripheral surface 7 of the internal recess 6 is accordingly larger than is the case for external grinding or a cylindrical, or moreover a non-cylindrical surface.

Figure 6:
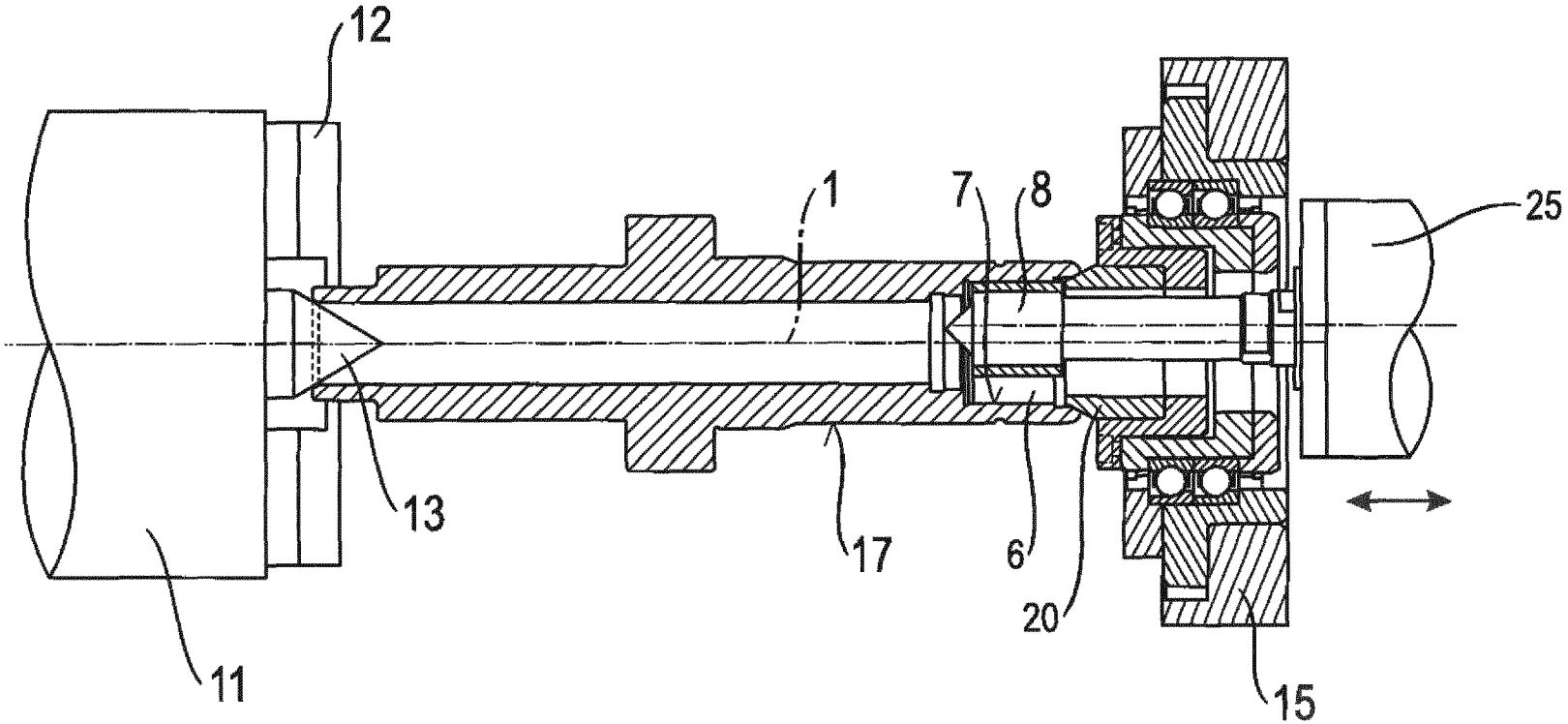
FIG. 6: shows a detailed view according to FIG. 5, with the internal grinding wheel in engagement with the internal recess of the machine part.

FIG. 6 shows a view according to FIG. 5, wherein, however, the internal grinding wheel 8 has been brought through the hollow bore of the hollow tailstock sleeve 15 into the internal recess 6 of the machine part 2 and into engagement with the peripheral surface 7 thereof. The further components or elements indicated by corresponding reference numerals correspond to those of FIG. 5, and are therefore not described again in detail here.

Figure 7:
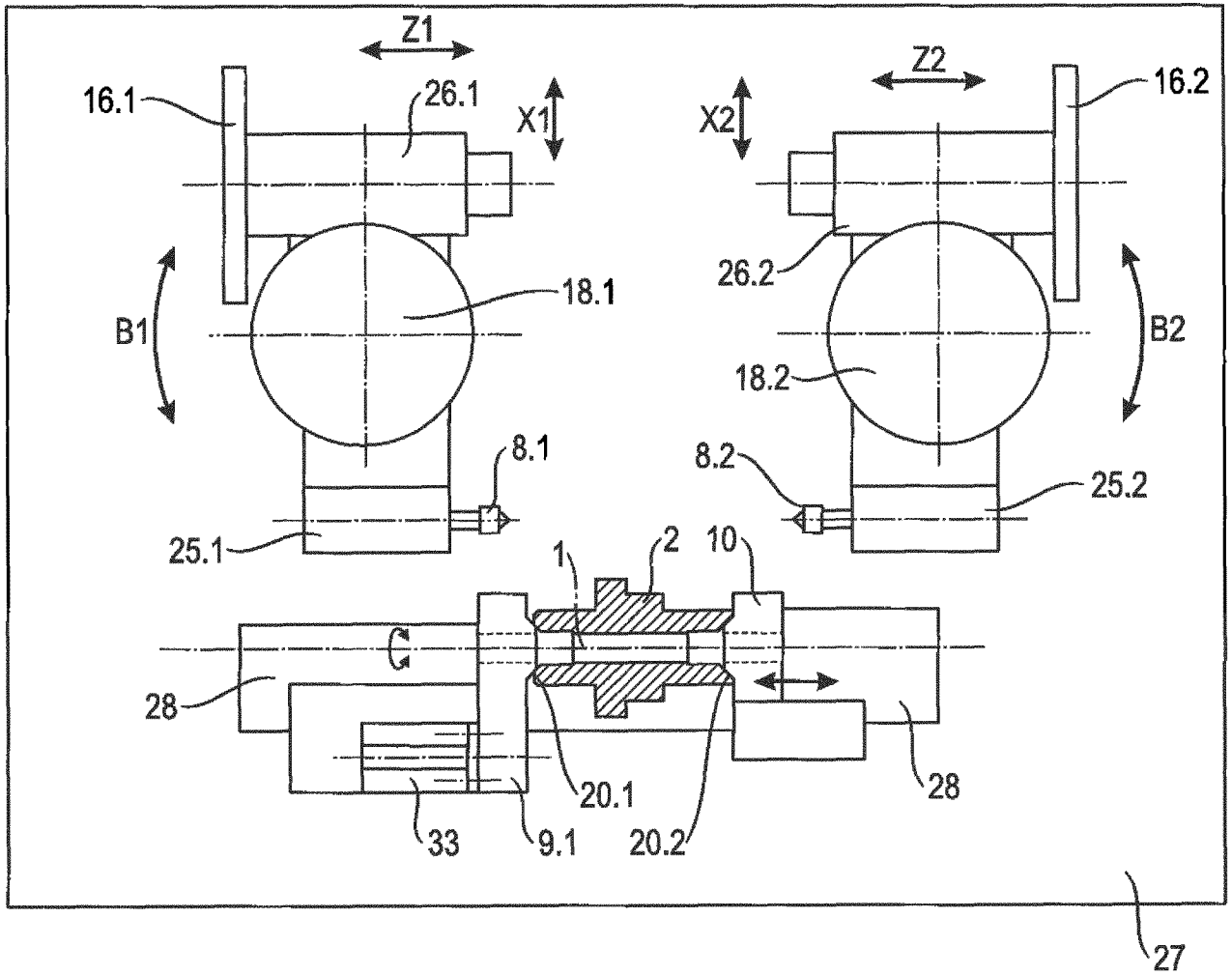
FIG. 7: shows a basic top view of a grinding machine according to the invention, with two grinding spindle heads.

FIG. 7 shows a further embodiment of a grinding machine according to the invention, wherein two separate grinding spindle heads 18.1, 18.2 are shown on the machine bed 27. The two grinding spindle heads 18.1, 18.2 each carry an external grinding wheel 16.1, 16.2 and an internal grinding wheel 8.1, with the corresponding internal grinding spindle 25.1, and/or 8.2, with the corresponding internal grinding spindle 15.2. The grinding spindle head 18.1 can swivel about a swivel axis B1, which is indicated by the double arrow. In an analogous manner, the grinding spindle head 18.2 can swivel about a swivel axis B2, which is likewise indicated by the double arrow. In the conventional manner, the grinding spindle heads 18.1 and 18.2 can be advanced in the X1- or X2-axis direction, as well as in the Z1- or Z2-direction, toward the longitudinal axis 1 of the machine part 2. As a result, it is possible that, for grinding the external contour of the machine part 2, the corresponding external grinding wheel 16.1 and/or 16.2 can be brought into engagement, whereas the machine part 2 with a central bore is centrically clamped both on its left end and on its opposite end 5 by means of hollow sleeves, such that the machine part 2 which has an internal recess on each of its ends can be ground internally on both ends by means of the internal grinding wheels 8.1 and 8.2. Such a configuration also enables the machine part 2, which is held in the manner described above on one end thereof in a workpiece headstock 9.1 arranged on the grinding table 28, but which is designed with a hollow chuck, and is held on the opposite end 5 in a hollow tailstock sleeve 15, to be held by means of respective hollow centers 20.1 and 20.2 (see FIG. 8) in such a manner that the left side internal recess and the right side internal recess can be ground at least partially at the same time. However, it is also possible with this configuration to grind the respective internal recess at least partially at the same time as the grinding of the external contour by means of either the first external grinding wheel 16.1 or the second external grinding wheel 16.2, using an internal grinding wheel arranged on the other grinding spindle head. It is also possible to perform the grinding, at least partially at the same time, using both of the external grinding wheels 16.1 and 16.2, specifically to grind the external contour using one of the two grinding wheels while the other of the two grinding wheels grinds the end faces. Such an arrangement therefore further increases the flexibility of the grinding machine according to the invention, although the equipment costs are higher. Such an arrangement can achieve a reduced cycle time despite complex contours of the machine parts being ground. The workpiece headstock 9.1 is driven by means of a drive motor 33 which is arranged with a housing axially parallel to the longitudinal axis 1 of the machine part 2. The tailstock 10 can slide in the Z-direction, but is not driven.

Figure 8:
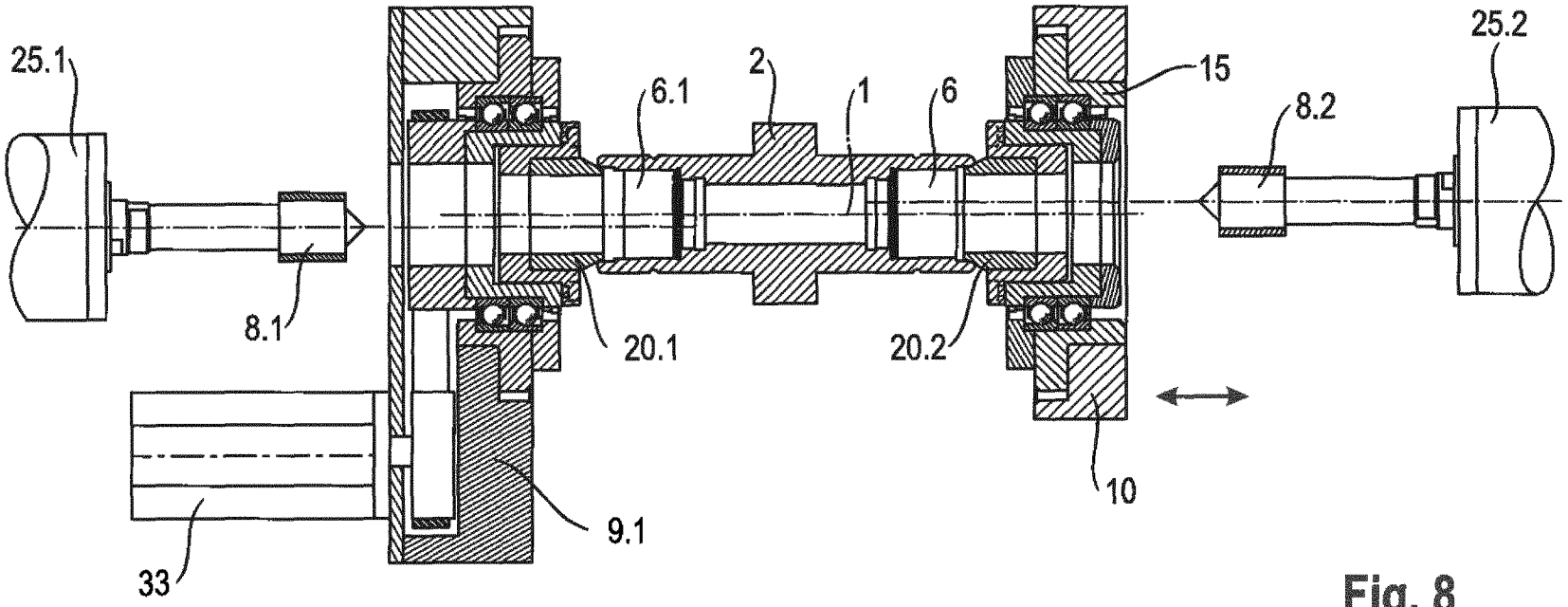
FIG. 8: shows a detailed view of the grinding machine according to the invention, with two internal grinding spindles for internal recesses present on both ends of the machine part.
Figure 9:
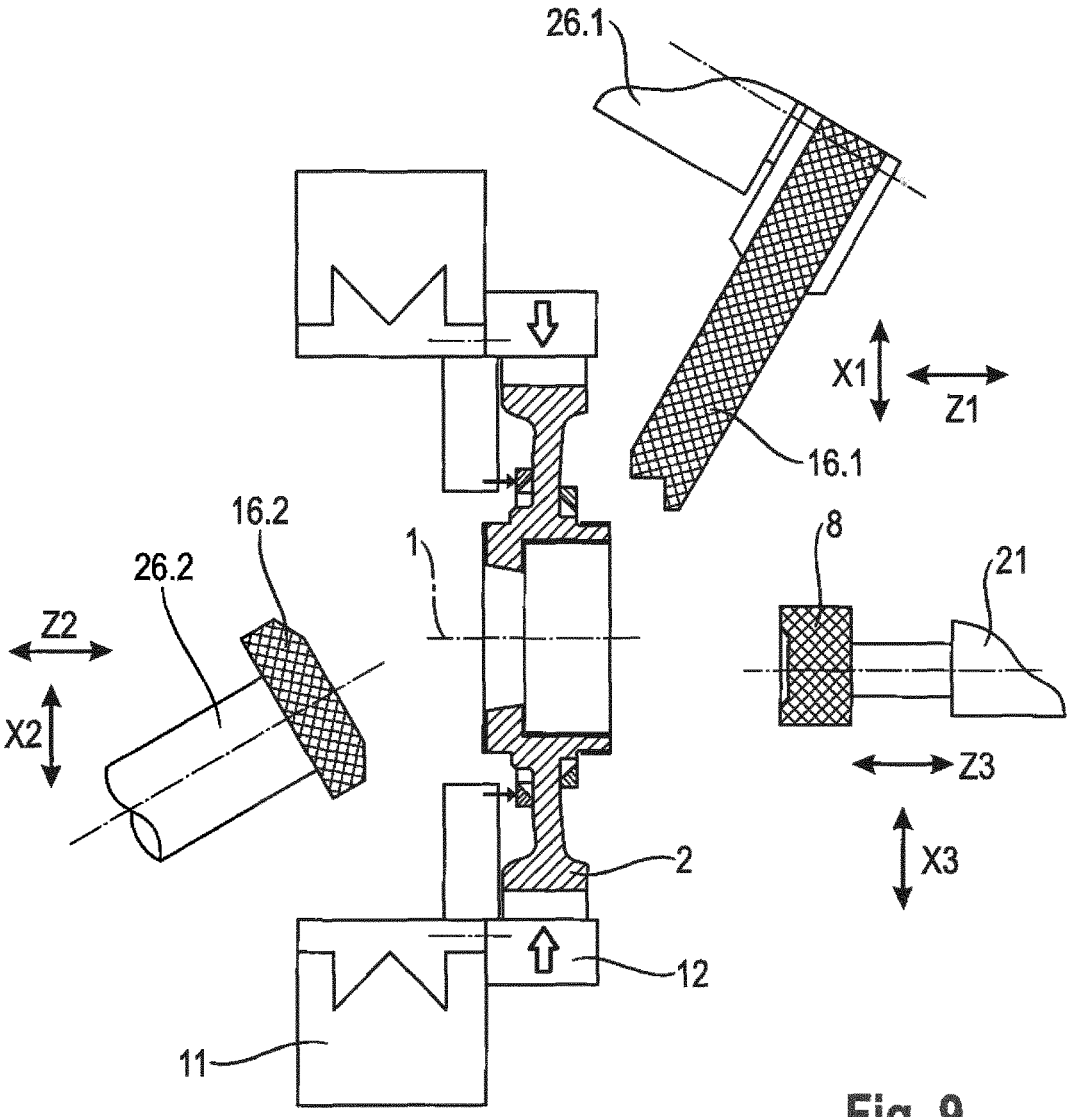
FIG. 9: shows a basic arrangement of a machine part in the form of a toothed wheel, which will be ground according to the method of the invention.

FIG. 8 shows the basic arrangement of FIG. 7, in an enlarged illustration. However, only the internal grinding wheel 8.2, with the corresponding internal grinding spindle 25.2, and the internal grinding wheel 8.1, with the corresponding internal grinding spindle 25.1, are ready for insertion through the respective hollow bores of the workpiece headstock 9.1 and/or tailstock 10. The mount and drive of the workpiece headstock 9.1 are illustrated on the left end of the centrically clamped machine part 2. To drive the centering tip 20.1 or the chuck, the drive motor 33 implemented via belts—particularly toothed belts—is included, in addition to the mount of this hollow workpiece headstock 9.1 with its short construction. The possible, at least partially simultaneous machining of the external and internal contours of the machine part 2 is carried out in the sequence and manner described above in connection with the other figures And finally, FIG. 9 shows a simplified illustrated embodiment for grinding a machine part 2, which, unlike in FIGS. 1 to 8, is not a shaft component, but rather a toothed wheel component. For simplicity, the corresponding grinding spindle heads are not shown. The centered clamping of this toothed wheel component is performed by the chuck 11 clamping the toothed wheel with its clamping jaws 12 on the outer toothing thereof. To achieve a precise alignment, end face stops are included on the chuck 11, and the toothed wheel is clamped against the same. This achieves an unambiguous orientation of the reference axis—namely the longitudinal axis 1 of the toothed wheel 2—which is fixed for the entire operation. Profiled external sections in the hub region of the toothed wheel are ground by means of a profiled external grinding wheel 16.1 which is mounted for driven rotation on a corresponding grinding spindle 26.1. Furthermore, an internal grinding wheel 8 is included, which is rotatably driven on the corresponding internal grinding spindle 21, and which can be inserted on a separate grinding spindle head into the hub boring via the Z3-axis, such that the hub bore can be ground at least partially at the same time as the external contour via an advancement along the X3-axis. An additional grinding spindle head (not shown) is included on the side of the chuck 11, and carries a grinding wheel 16.2 with associated spindle 26.2. The external grinding wheel 16.2 is a profiled grinding wheel and is used to grind the end faces on the collar and/or on the hub of the toothed wheel 2. Likewise, both the external contour and the internal contour of this toothed wheel can be ground according to the invention at least partially at the same time.

The invention claimed is:

1. A method for the grinding, in a single clamping, of a machine part made to rotate about its longitudinal axis, clamped on both of its axial ends and having an internal recess on at least one of its ends which is ground by means of an internal grinding wheel, wherein the machine part is held rotatingly driven between a workpiece headstock and a tailstock, in a single clamping, and the external contour thereof is ground by means of at least one grinding wheel, wherein a) the machine part is held centrically on the tailstock by means of a live or rotationally driven hollow tailstock sleeve on the end region of the internal recess, b) the internal grinding wheel passes through the hollow tailstock sleeve during the grinding of the internal recess, and c) the grinding of the internal recess and the grinding of the external contour of the machine part are performed at least partially at the same time, and d) the clamping on the workpiece headstock is performed with a centrically clamping chuck or with a chuck having equalizing jaws, and a center with engages with the end face of the machine part.

2. The method according to claim 1, wherein the grinding is performed without any change in the reference axes of the clamping, and without the support of a steady rest.

3. The method according to claim 1, wherein the center is hollow, and a further internal grinding wheel passes through the same to grind a further internal recess.

4. The method according to claim 1, wherein the internal grinding wheel and the grinding wheel engage with and disengage from the machine part as a result of a single, shared grinding spindle head swiveling and/or moving in a particularly continuous manner, the same being moved by a swiveling arrangement on a carriage to grind the internal recess and to grind the external contour in a direction parallel to the longitudinal axis of the machine part.

5. The method according to claim 1, wherein the grinding wheel is arranged on a grinding spindle head, and the swiveling thereof produces the grinding engagement with the machine part.

6. The method according to claim 5, wherein the internal grinding wheel is arranged on a separate grinding spindle head in the region of the tailstock, and is moved in the direction of the longitudinal axis of the machine part to pass through the hollow tailstock sleeve.

7. The method according to claim 1, wherein, when the external contour of the machine part is ground, the rotational axis of the grinding wheel, and the longitudinal axis which runs through the workpiece headstock, the machine part, and the tailstock, are oriented at an oblique angle relative to each other in space such that the contact between the grinding wheel and the external contour of the machine part is substantially only punctiform, and the longitudinal feed is performed in the direction approaching the workpiece headstock.

8. The method according to claim 1, wherein, when the external contour of the machine part is ground, the rotational axis of the grinding wheel, and the longitudinal axis which runs through the workpiece headstock, the machine part, and the tailstock, are oriented in the plane at an angle relative to each other such that the contact between the grinding wheel and the external contour of the machine part is substantially linear in shape, as in angular plunge grinding.

9. The method according to claim 1, wherein the grinding wheel can grind both peripheral regions and end faces of the machine part.

10. The method according to claim 1, wherein the hollow tailstock sleeve is live.

11. The method according to claim 1, wherein the grinding of the machine part is controlled with CNC.

12. A grinding machine designed as a universal circular grinding machine and/or a non-circular grinding machine, to carry out the method according to claim 1, including the following features:

a) a workpiece headstock and a tailstock, wherein a machine part which will be ground can be clamped between the same, are arranged on a grinding table, and the longitudinal axis running through the workpiece headstock, the machine part, and the tailstock runs in the longitudinal direction of the grinding table, b) the workpiece headstock has a centrically clamping chuck or a chuck with equalizing, releasable jaws, and a centering tip which holds and rotates the machine part on the workpiece headstock, c) the tailstock has a live or rotationally driven hollow tailstock sleeve with a hollow center, adapted to center and engage with the end of the machine part opposite the workpiece headstock, at least in a rotationally symmetric internal recess, d) the hollow tailstock sleeve with the hollow center has an internal bore through which an internal grinding wheel carried on a grinding spindle head can pass to grind the internal recess, and e) the workpiece headstock and the tailstock can move relative to each another in such a manner that the machine part is held and rotationally driven under axial pressure between the centering tip on the workpiece headstock and the hollow center on the tailstock, without any change in the reference axis of the clamping.

13. The grinding machine according to claim 12, wherein the grinding spindle head which carries the internal grinding wheel can swivel about a vertical swivel axis and is arranged on a carriage which can move perpendicular to the longitudinal direction of the grinding table in a controlled manner, and additionally accommodates a rotationally driven grinding wheel with a horizontal axis of rotation, for the grinding of the external contour of the machine part.

14. The grinding machine according to claim 12, wherein the grinding spindle head which carries the internal grinding wheel is a separate grinding spindle head in the region of the tailstock and/or in the region of the chuck which comprises a hollow center, and the internal grinding wheel can be advanced into the internal recess and against its peripheral surface.

15. The grinding machine according to claim 12, wherein the peripheral surface and the end face of the grinding wheel each have a grinding layer.

16. The grinding machine according to claim 12, wherein the internal grinding wheel and the grinding wheel each have a CBN coating.

17. The grinding machine according to claim 12, wherein the chuck is hollow and enables the passage of a further internal grinding wheel to grind a further internal recess of the machine part on the workpiece headstock end thereof.

* * * * *